US005440861A

United States Patent [19]

Lund

[11] Patent Number: 5,440,861

[45] Date of Patent: Aug. 15, 1995

[54] METHOD AND APPARATUS FOR EMPTYING ENVELOPES

[75] Inventor: Bernd Lund, Hamburg, Germany

[73] Assignee: Stielow GmbH & Co. KG, Norderstedt, Germany

[21] Appl. No.: 323,699

[22] Filed: Oct. 18, 1994

Related U.S. Application Data

[63] Continuation of Ser. No. 35,573, Mar. 23, 1993, abandoned.

[30] Foreign Application Priority Data

Apr. 9, 1992 [DE] Germany ..... 42 11 885.9

[51] Int. Cl.[6] ..... B65B 69/00; B65B 43/30

[52] U.S. Cl. ..... 53/492; 53/381.3; 53/381.6; 83/912; 414/412

[58] Field of Search ..... 53/381.3, 381.6, 381.5, 53/381.6, 492, 75, 76; 83/912, 404.2, 404.3

[56] References Cited

U.S. PATENT DOCUMENTS

| | | | |
|---|---|---|---|
| 3,238,926 | 3/1966 | Huck | 53/381.6 |
| 3,726,454 | 4/1973 | Robbins | 53/381.6 |
| 4,016,708 | 4/1977 | DeHart | 53/381.6 |
| 4,123,890 | 11/1978 | Russell et al. | 53/396 |
| 4,233,800 | 11/1980 | Long et al. | 53/381.6 |
| 4,295,321 | 10/1981 | DeHart et al. | 53/381.6 |
| 4,373,848 | 2/1983 | Bishop | 53/381.6 |
| 4,626,236 | 12/1986 | Maurer | 53/381.6 |
| 4,863,037 | 9/1989 | Stevens et al. | 53/381.3 |
| 4,866,908 | 9/1989 | Kunne et al. | 53/386 |
| 4,893,454 | 1/1990 | Russell | 53/492 |
| 4,921,388 | 5/1990 | Nelson | 414/412 |
| 5,052,875 | 10/1991 | Miller et al. | 53/381.6 |
| 5,054,700 | 10/1991 | DeWitt | 53/381.3 |
| 5,115,918 | 5/1992 | DeWitt et al. | 209/3.1 |
| 5,156,515 | 10/1992 | Charron et al. | 53/381.3 |
| 5,240,116 | 8/1993 | Stevens et al. | 209/534 |

FOREIGN PATENT DOCUMENTS

| | | |
|---|---|---|
| 0048485 | 3/1982 | European Pat. Off. . |
| 0279870 | 2/1987 | European Pat. Off. . |
| 2135481 | 12/1972 | France . |
| 2428529 | 1/1980 | France . |
| 2471223 | 6/1981 | France . |

*Primary Examiner*—Horace M. Culver
*Attorney, Agent, or Firm*—Staas & Halsey

[57] ABSTRACT

Envelopes of different dimensions opened on three edges, namely one short edge and two long edges, are fed standing on one of the opened long edges to a removal device, in which both envelope sides (U and V) are deflected to the left and right by approximately 90°. The envelope contents (Z) is conveyed linearly out of the removal device. The removal device is formed by two vertical suction cylinders (25, 26) positioned to the left and right alongside the envelope and which, under sensor control, engage the envelope sides, deflect them by approximately 90° and consequently separate the sides from the envelope contents. The envelope is then ejected at one side, and the unopened short edge at the rear of the envelope assists the linear movement of the contents out of the apparatus. A third cutting or opening mechanism (23) for the lower long edge forms, together with the suction cylinders (25, 26) and the other rotated parts of the removal device, a compact constructional unit. All the parts are advantageously jointly driven and cooperate to effectively remove the envelope contents. The apparatus has a compact construction and permits completely automatic removal of the envelope contents. Processing can be monitored visually by an operator without any difficulty.

19 Claims, 7 Drawing Sheets

METHOD AND APPARATUS FOR EMPTYING ENVELOPES

This application is a continuation, of application No. 08/035,573, filed Mar. 23, 1993, now abandoned.

BACKGROUND OF THE INVENTION

The invention relates to a method and an apparatus for emptying envelopes which are opened on three edges.

U.S. Pat. No. 4,893,454 discloses an apparatus of the aforementioned type, in which the envelopes are opened on two short edges and one long edge, and are fed to a removal device where the envelope sides are bent laterally downwards by levers provided with suction means in order to fold the envelope sides, so that the envelope contents become visible and are exposed. The contents can then be removed. This is brought about by successively transferring the opened envelopes into an open conveying mechanism, in which several envelopes are presented for removal.

U.S. Pat. No. 4,921,388 discloses an apparatus, which can only process envelopes having a specific format, which is adjusted beforehand. In this apparatus, two short edges and one long edge of each envelope are opened. The envelopes are conveyed horizontally to a removal device which separates the envelope from the contents and draws it off downwards. The contents are ejected in an uncontrolled manner.

U.S. Patent 4,295,321 discloses an apparatus through which each envelope is opened on two short edges and one long edge and is supplied horizontally to a vacuum drum, which has a suction action on one opened envelope side and in this way conveys the envelope away downwards. The contents are engaged by a removal roll. The vacuum drum only engages one envelope side and draws downwards the entire envelope, as a result of the connection with the unopened, long edge.

European Patent 279,870 discloses a compactly constructed apparatus through which envelopes opened on one edge are deformed by a suction mechanism in order to remove the contents. With this apparatus, a single opened envelope is presented in the removal station, so that the removal capacity is limited.

There exists a need in the art for a method and an apparatus of the aforementioned type, in which the apparatus is so compactly constructed that the envelope only has to travel short distances, wherein simultaneous processing of different envelope formats is provided and wherein there is automatic removal of the envelope contents.

SUMMARY OF THE INVENTION

It is an object of the present invention to satisfy the above-described needs in the art.

According to the present invention, each envelope is opened on one short edge and two long edges. Thus, only one short edge is not opened. The envelope opened in this way is fed standing on one of the opened long edges to the removal device, where the two envelope sides are removed to the left and right, preferably at an angle of approximately 90°. The contents is conveyed linearly and removed or it can be supplied to further processing apparatus. Removal always takes place completely automatically in the apparatus of the present invention. The unopened short edge at the rear in the conveying direction assists the removal movement in that the two envelope sides are drawn off to the left and right, and the rear edge correspondingly acts on the envelope contents in the direction of its desired linear movement.

In an advantageous embodiment of the present invention, the opening of the second long edge takes place while the envelope is positioned vertically and immediately prior to the entry into the removal mechanism. This leads to a compact construction making it possible to jointly drive the cutting mechanism for the second long edge, which is then located at the bottom, and the removal mechanism. Due to the fact that the envelope sides are drawn off to the left and right, it can be detected either visually or by corresponding sensors whether in fact the total contents has been conveyed onward linearly. As removal takes place completely automatically, the operator can concentrate on monitoring and/or sorting. The movable parts are substantially relatively slowly rotating parts, so that noise emission is limited.

BRIEF DESCRIPTION OF THE DRAWINGS

The invention is described in greater detail hereinafter relative to a non-limitative embodiment and the attached drawings, wherein like numerals refer to like parts throughout.

DETAILED DESCRIPTION OF THE PREFERRED EMBODIMENT

Figure 1:
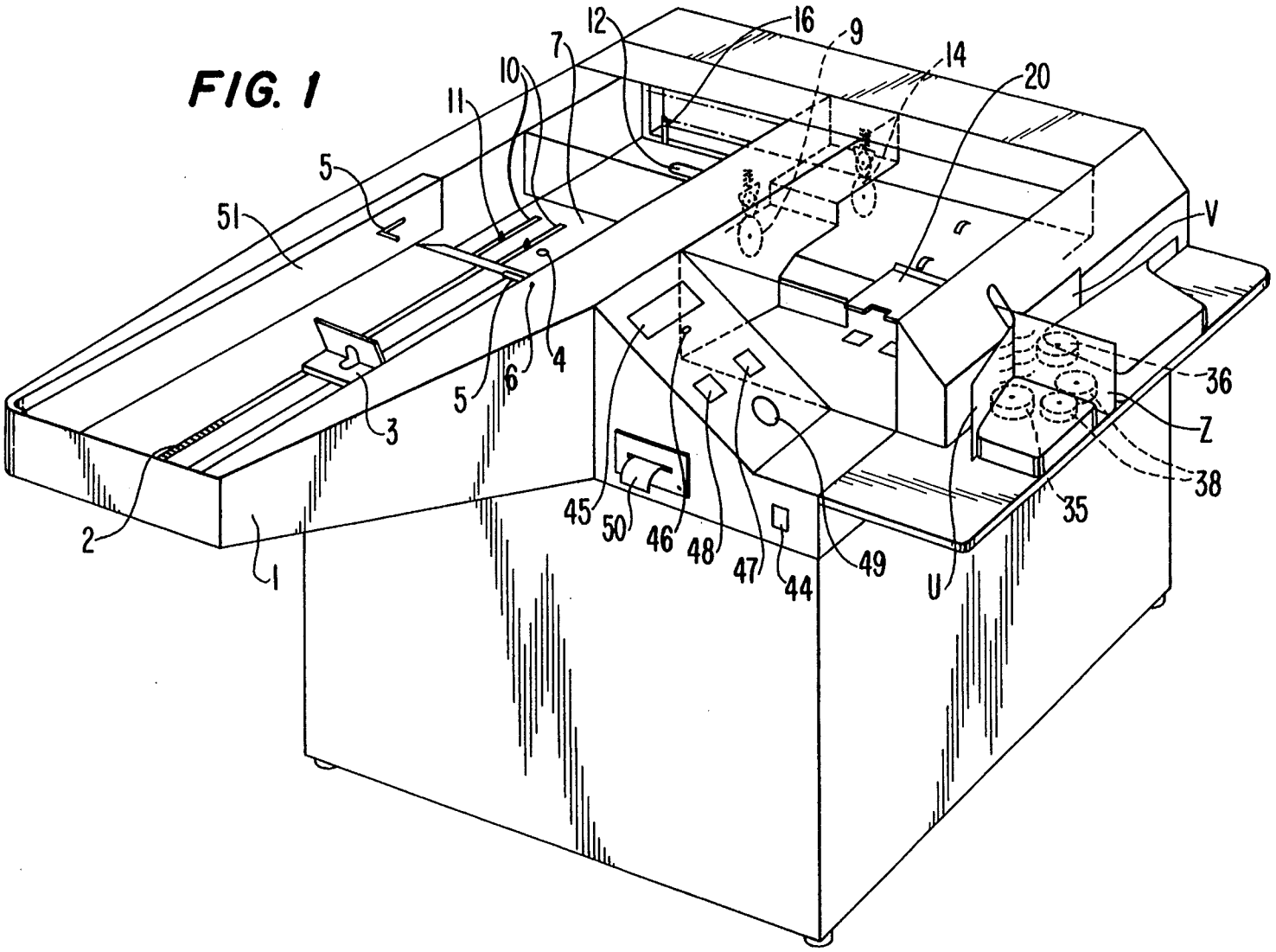
FIG. 1 is a perspective view of an embodiment of an envelope emptying apparatus in accordance with the present invention.
Figure 2:
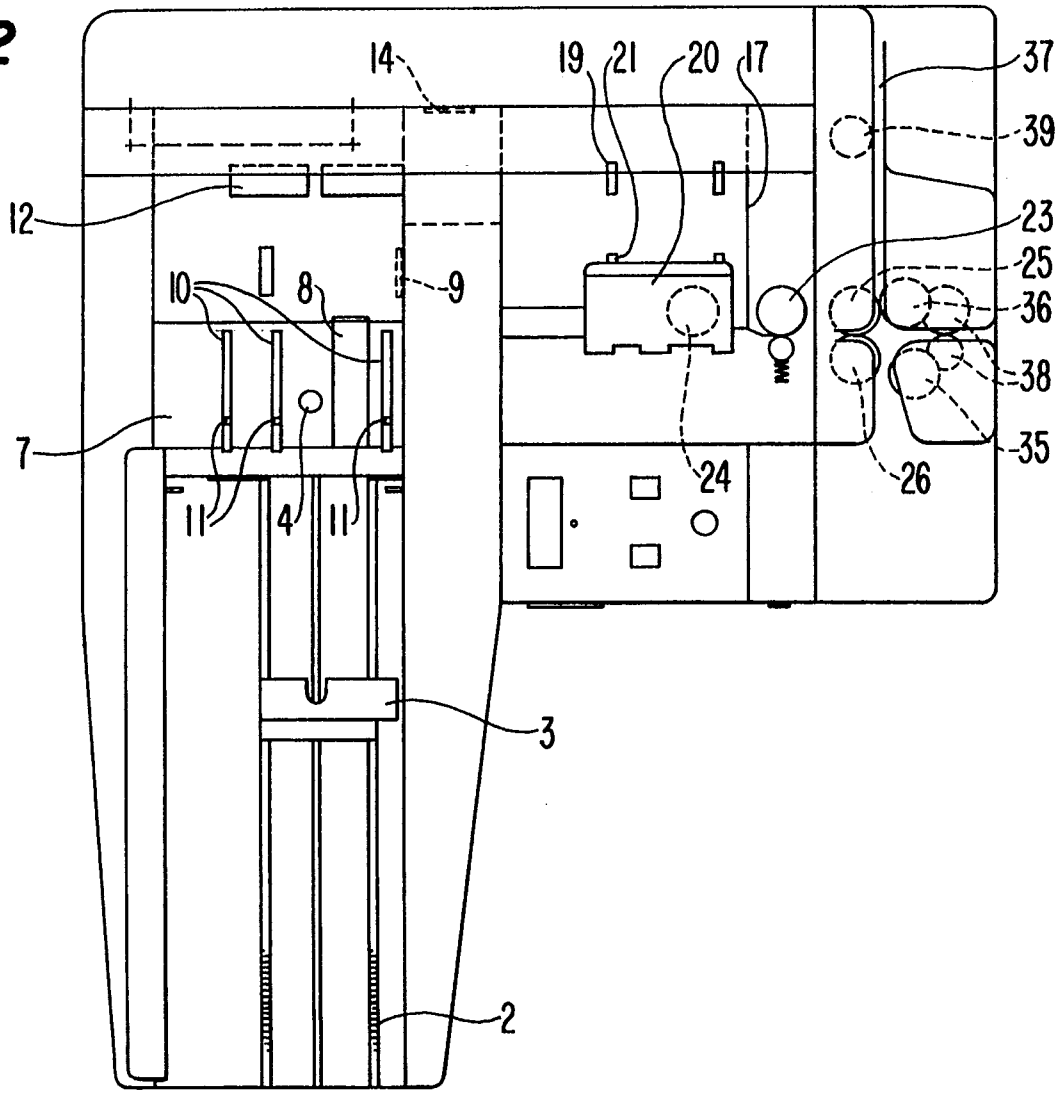
FIG. 2 is a plan view of the apparatus of FIG. 1.

In accordance with the apparatus of the present invention shown in the drawings, envelopes of different size can be simultaneously processed and emptied, so that no sorting is necessary. In general, an envelope has two short edges, two long edges and two faces or sides. Referring to FIGS. 1 and 2, envelopes are stacked with one short edge oriented to the right in the feed hopper 1. In the vicinity of the feed hopper 1 are provided toothed belts 2 which convey the stack of envelopes by means of an advance weight 3 towards a removal suction arm 4. Retaining fingers 5 are coupled to a sensor 6 and ensure a correct removal position for removing the inserted envelopes from the stack. By means of the vacuum-operated suction arm 4, an individual envelope is removed from the hopper 1 and placed on a conveying plane. A continuously driven rubber roller 8 ensures correct positioning of the envelope for opening one short envelope edge.

Figure 7:
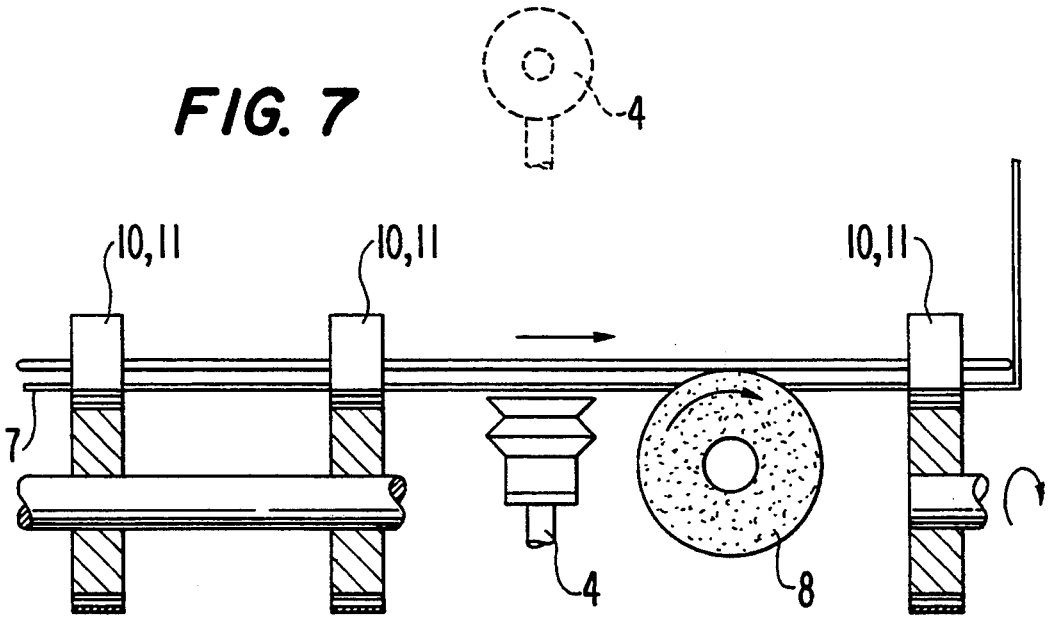
FIG. 7 is a detailed side view of a portion of the apparatus for supplying the envelopes to a first cutting or slitting mechanism.

To convey the envelope into a first cutting mechanism 9, three toothed belts 10 with conveying cams 11 are located in the conveying plane 7. The arrangement is such that even though the envelopes have different sizes usually at least two of the three conveying cams 11 engage each envelope for positive conveying towards the first cutting mechanism 9. This is illustrated in FIGS. 1, 2 and 7.

Figure 8:
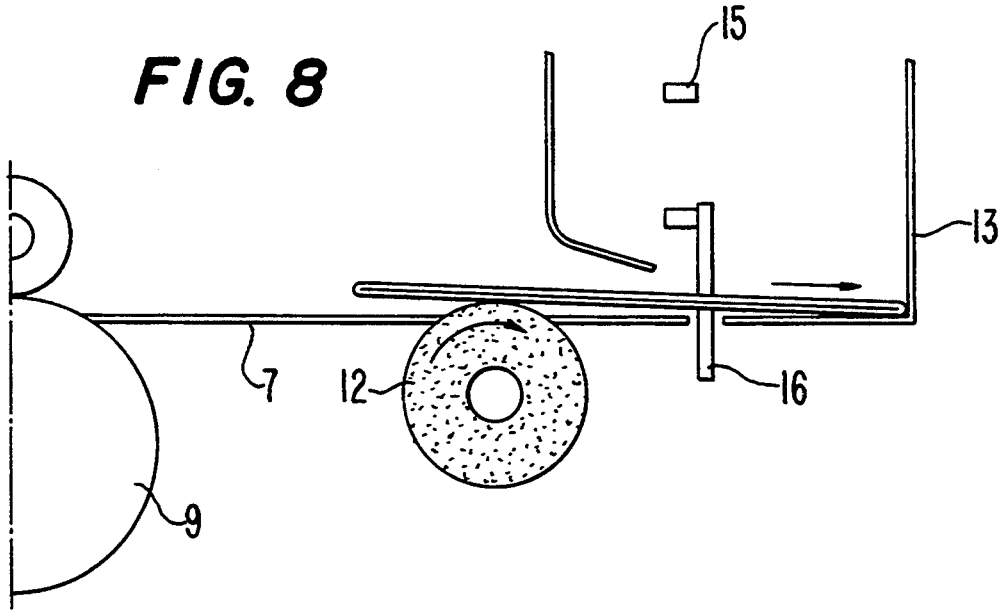
FIG. 8 is a detailed side view of a portion of the apparatus for supplying the envelopes to the second slitting or cutting mechanism.

By means of the first cutting mechanism 9 and a rubber roller 12 the envelope is conveyed and positioned so that one long edge abuts a guidance edge 13 of a second cutting mechanism 14 and is positioned there (see FIG. 8). During this processing and movement the envelope is on the conveying plane 7 illustrated in FIGS. 7 and 8.

Figure 6:
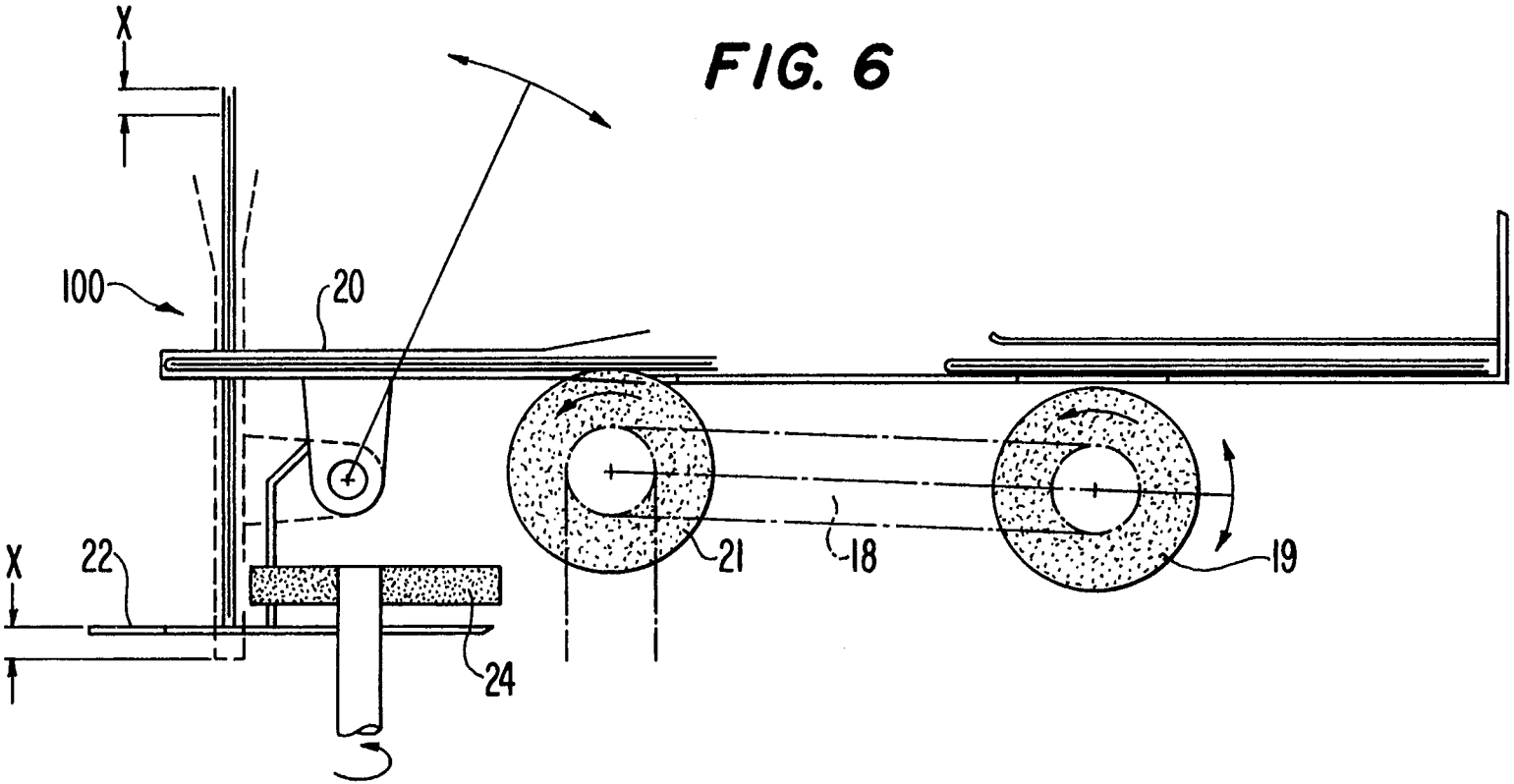
FIG. 6 is a detailed side view of a portion of the apparatus for transferring envelopes already opened on two sides into the final processing area of the apparatus of FIG. 1.

A chain drive 15 with conveying fingers 16 (see FIG. 8) is located above the conveying plane 7. The conveying fingers 16 move the envelope into the second cutting mechanism 14 for opening one long edge of the envelope. The envelope which has been opened in the second cutting mechanism 14 (see FIGS. 1 and 2) is conveyed by the second cutting mechanism 14 against a right-hand sidewall 17 of the conveying plane 7 (FIG. 2). A rocker arm 18 with a continuously driven rubber roll 19 (see FIG. 6) is positioned below the conveying plane 7.

The rubber roll 19 conveys the envelope, when the latter projects into the conveying plane, into a pocket 20 of a reversing station 100 located in the movement direction. A second rubber roll 21 mounted on the fulcrum of the rocker arm 18 ensures correct positioning of the envelope. The pocket 20 is pivoted by 90°, in order to place an envelope received by pocket 20 into an upright position, i.e., to bring the envelope into a vertical position. As a result, the upright envelope contacts an underlying conveying surface 22, in which is located a third cutting mechanism 23. The envelope stands here on its still unopened second long edge. It is raised in the pocket 20 by an amount x (see FIG. 6) and oriented on the conveying surface 22. An eccentric 24 is used to insert the envelope into the third cutting mechanism 23 with the aid of friction.

The third cutting mechanism 23 opens the lower second long edge of the envelope and conveys the envelope in the direction of the removal mechanism or device, which is formed by two upright suction cylinders 25, 26. A stationary sensor 27 (FIG. 3) controls the vacuum supply to openings 28 in the two suction cylinders 25, 26 (see FIG. 3) and starts the rotary movement thereof. These parts are illustrated by the plan view of FIG. 3, together with the driving apparatus for the different rotated parts and their mounting. It can be seen that the construction is very compact and that in this area only rotary parts are used to process the envelope.

The positioning of the openings 28 in the two suction cylinders 25, 26 is controlled based on the output of a sensor 29 and a coupling - brake combination on a driving shaft 30. The rotary movement of the driving shaft 30 is transferred to the other rotated parts by belts and gears, as can be seen from FIG. 3. A gear pair 31 drives the suction cylinder 26, which is resiliently mounted on a rocker arm 32 to ensure adaptation to different envelope thicknesses.

Figure 5:
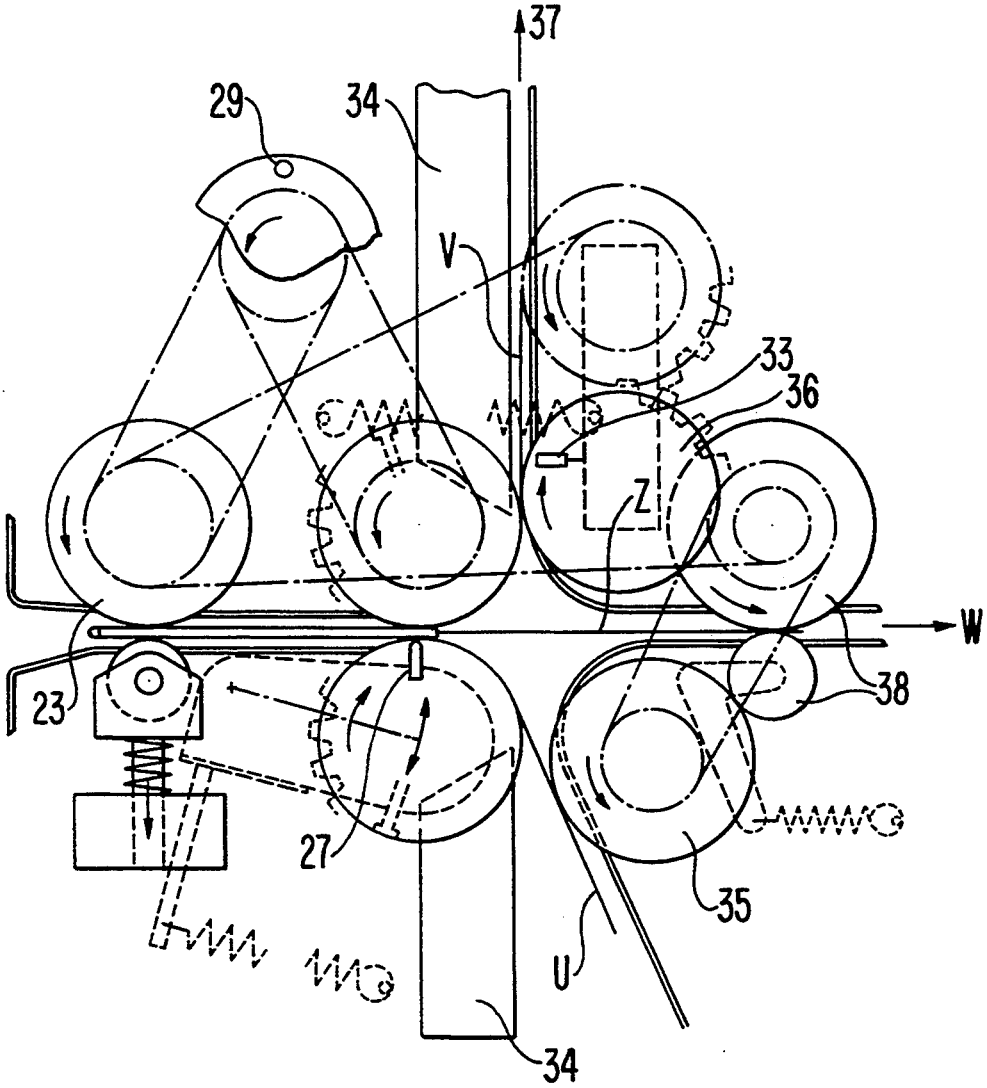
FIG. 5 is a plan view similar to FIG. 3, but with an envelope in a further advanced stage of the removal process.

Two rails 34 are used for stripping off the envelope sides U and V following deflection by the suction cylinders and after disconnection of vacuum is initiated by the sensor 33 (see FIG. 5). A front friction roll 35 is used for fanning out one envelope side U. A facing second friction roll 36 is resiliently mounted and frictionally draws the other side V of the envelope into an ejection path 37. In the conveying direction of the upright-conveyed envelope, the suction cylinders 25, 26 are followed by a pair of rolls 38 for engaging and removing the envelope contents.

The envelope which is opened on one short edge and one long edge in a more or less conventional manner is then subject to upright positioning by the pocket 20 and is conveyed upright into the third cutting mechanism 23 to open the still closed second long edge which is positioned at the bottom of the envelope. As can in particular be gathered from FIG. 3, cutting mechanism 23 forms a compact unit which cooperates with the removal device to effect removal of the envelope contents.

During the opening of the envelope at the bottom, long edge, it is conveyed into the suction cylinders 25, 26. The envelope sides U and V are transported by the vacuum present at the openings 28 and deflected by approximately 90° until they are stripped off on the rails 34. The envelope contents Z are moved on linearly in the direction of arrow W (see FIG. 5). The more rapidly rotating friction roll 35 fans out the envelope side U. The other friction roll 36 engages the other envelope side V and moves it into the ejection path 37. As a result of this movement of the entire envelope, which at one short edge still connects the two sides U and V, this rear closed short edge pushes on the envelope contents Z and assists the conveying movement of the contents Z by the roll pair 38, so that there is an automatic removal of the contents Z. The reception and processing by corresponding, succeeding apparatus is then possible.

In accordance with the present invention, the inside of the envelope is clearly visible to the operator along its extent as it travels to ejection path 37, so that an optical check is possible. This check can also be performed automatically by sensors. At the start of the next envelope processing cycle the emptied envelope is ejected by an ejector roll 39.

Figure 3:
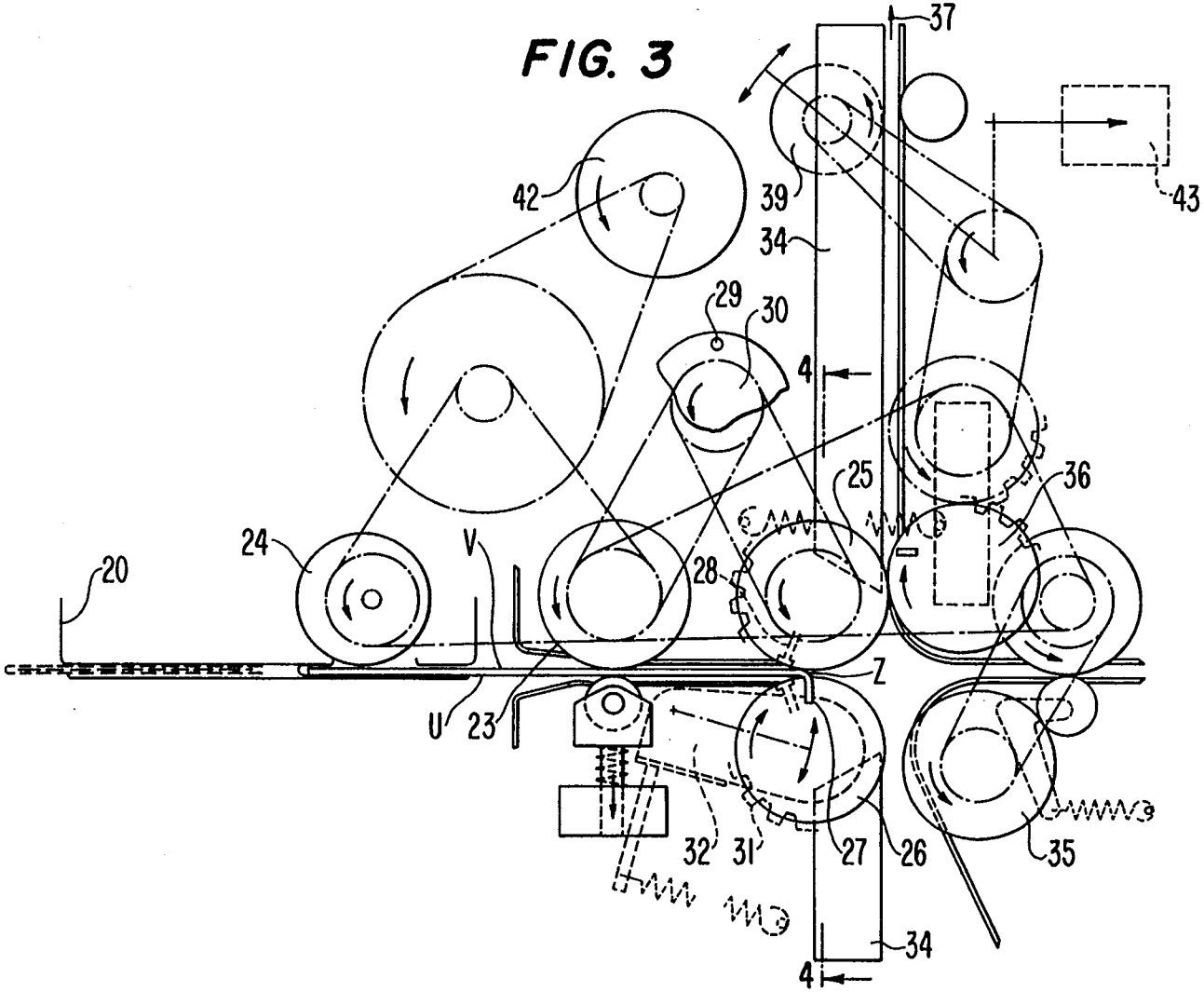
FIG. 3 is an enlarged plan view of a removal device or mechanism used in the apparatus of FIG. 1.
Figure 4:
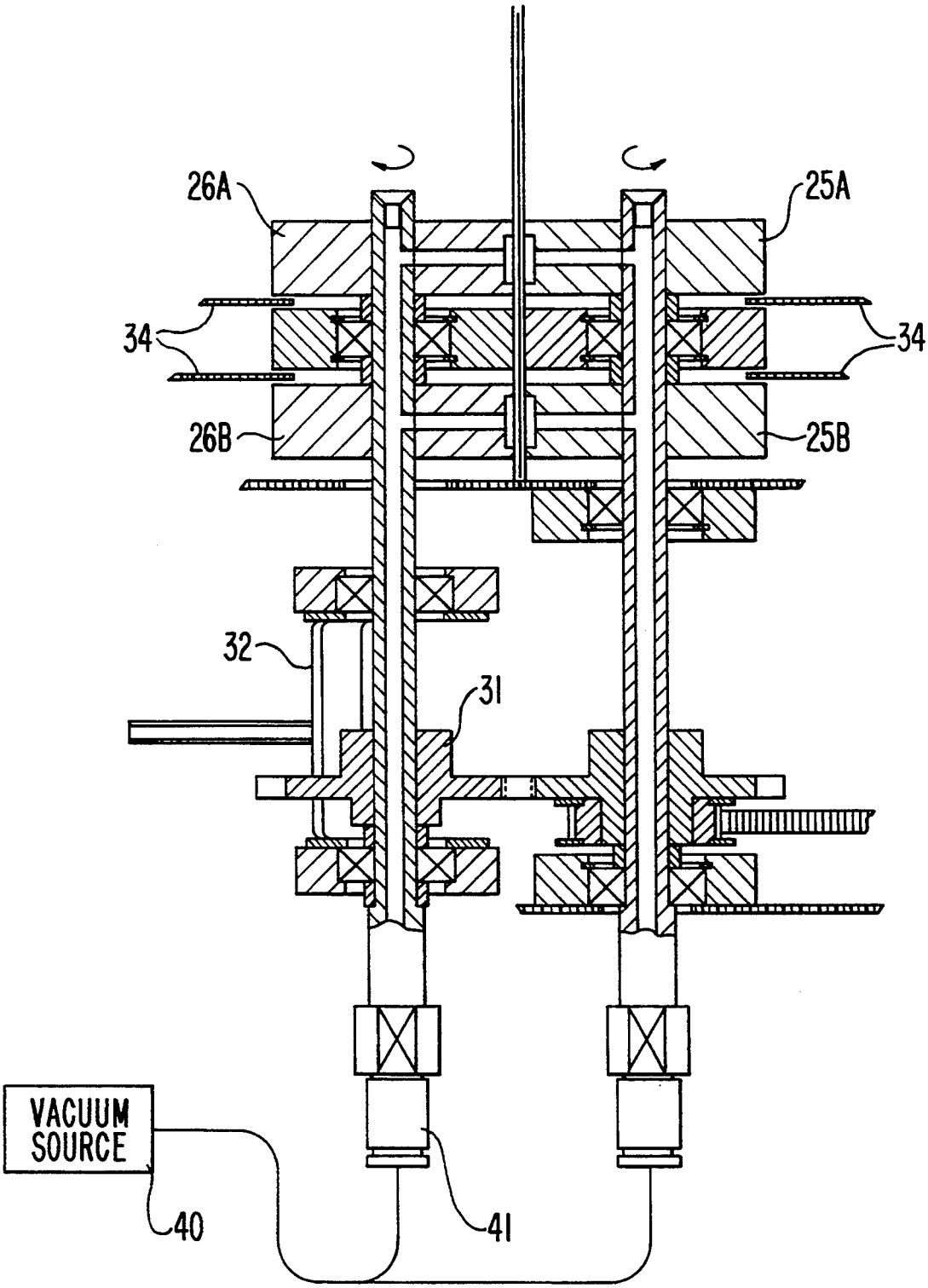
FIG. 4 is a sectional view taken along line 4—4 in FIG. 3.

FIG. 4 shows an embodiment of the suction cylinder construction. In this embodiment, each suction cylinder 25, 26 has two suction sections 25*a*, 25*b* or 26a, 26*b* mounted on corresponding shafts. There is a suction opening 28 in each suction section (see FIG. 3). The openings 28 are supplied with vacuum by means of a vacuum source 40 and a rotary suction air passage 41, which forms a connection to a bore in each driving shaft. FIG. 4 shows the gears 31 and corresponding driving apparatus, together with the mounting parts, which are also shown in FIG. 3. In FIGS. 3 and 4, it can also be seen that the corresponding cylinders or rolls are resiliently mounted on rocker arms or levers, to ensure adaptation to different envelope thicknesses.

FIG. 3 shows an envelope initially entering the vicinity of the suction cylinders 25, 26. In FIG. 5 processing is further advanced, i.e., the envelope is leaving the third cutting mechanism 23 and the envelope sides U and V are already deflected, so that the envelope contents Z have reached the vicinity of the rolls 38. This position is also shown in FIG. 1. It can be seen that the envelope is conveyed upright into the vicinity of the removal device and that the envelope contents Z are conveyed and removed linearly, so that there is maximum certainty of the entire Contents being engaged by the roll pair 38. The inside of the deflected envelope, sides U and V is clearly visible, so that it is possible to establish if the entire envelope contents have not been linearly removed.

FIGS. 1 and 3 also show a driving motor 42, a pull magnet 43, the equipment master switch 44, a display 45, a counter reset button 46, and an automatic stopping mechanism 47. There is also an individual release 48, as well as a stepless speed control 49, a statistical circuit with printer 50 and an adjustable side guide 51. The apparatus has a very compact construction and this is assisted by integrating the third cutting mechanism with the removal device.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be resorted to as falling within the scope of the invention in the appended claims and their equivalents.

What is claimed is:

1. A method for emptying envelopes, comprising the steps of:

opening an envelope on a first short edge and first and second long edges;

conveying the opened envelope upright to a removal device while standing on the second long edge;

drawing apart the two envelope sides which are only interconnected by a second short edge, laterally in different directions to linearly convey any contents of the envelope away from the envelope by using a portion of the envelope adjacent the interconnected second short edge to assist in the removal of any contents of the envelope.

2. A method according to claim 1, wherein said opening step comprises:

first opening the envelope on the first short edge and the first long edge; and feeding the envelope in the upright position while opening the second long edge.

3. Apparatus for emptying envelopes, comprising:

means for opening envelopes on a first short edge and first and second long edges;

means for feeding the opened envelopes in an upright orientation;

a removal device for receiving the envelopes opened on the first short edge and the first and second long edges standing on one of the first and second long edges, said removal device including a draw out mechanism for the envelope, which laterally draws apart the two envelope sides interconnected by a second short edge in different directions and linearly conveys any contents of the envelope to remove the contents.

4. Apparatus according to claim 3, wherein said opening means comprises an opening mechanism for receiving the envelopes initially opened on the first short edge and the first long edge, conveyed standing on the still closed second long edge, and for opening the second long edge.

5. Apparatus according to claim 4, wherein said draw out mechanism comprises first and second standing, rotated suction cylinders positioned on opposite sides of the opened envelope to exert suction on the envelope sides to laterally deflect and separate the envelope sides.

6. Apparatus according to claim 5, further comprising:

means for maintaining the suction action of each of each first and second suction cylinders until there has been an approximately 90° deflection of each of the envelope sides; and sensors for sensing the suction action at the envelope entrance and at the 90° deflection point.

7. Apparatus according to claim 6, wherein said first suction cylinder is resiliently mounted to adapt to different envelope thicknesses.

8. Apparatus according to claim 7, further comprising:

a first friction roll for fanning out a first deflected envelope side; and a second friction roll which is resilient, for the frictional ejection of a second deflected envelope side.

9. Apparatus according to claim 8, further comprising removal rolls for continuing the linear removal movement of any contents of the envelope after passing said first and second suction cylinders.

10. Apparatus according to claim 9, further comprising a vacuum source, wherein each of said first and second suction cylinders includes two superimposed suction sections, each of which is provided with a suction opening connected to said vacuum source.

11. Apparatus according to claim 5, wherein said first suction cylinder is resiliently mounted to adapt to different envelope thicknesses.

12. Apparatus according to claim 5, further comprising:

a first friction roll for fanning out a first deflected envelope side; and a second friction roll which is resilient, for the frictional ejection of a second deflected envelope side.

13. Apparatus according to claim 6, further comprising:

a first friction roll for fanning out a first deflected envelope side; and a second friction roll which is resilient, for the frictional ejection of a second deflected envelope side.

14. Apparatus according to claim 5, further comprising removal rolls for continuing the linear removal movement of any contents of the envelope passing said first and second suction cylinders.

15. Apparatus according to claim 6, further comprising removal rolls for continuing the linear removal movement of any contents of the envelope passing said first and second suction cylinders.

16. Apparatus according to claim 5, further comprising a vacuum source, wherein each of said first and second suction cylinders includes two superimposed suction sections, each of which is provided with a suction opening connected to said vacuum source.

17. Apparatus according to claim 6, further comprising a vacuum source, wherein each of said first and second suction cylinders includes two superimposed suction sections, each of which is provided with a suction opening connected to said vacuum source.

18. Apparatus for emptying envelopes, comprising:

means for feeding and opening an envelope on first, second and third edges;

means for positioning the envelope on the third edge and for feeding the envelope upright on the third edge; and means for separating first and second sides of the envelope so as to cause a fourth edge of the envelope to push any contents of the envelope away from the envelope.

19. A method for automatically emptying envelopes, comprising:

automatically opening an envelope on first, second and third edges;

automatically feeding the opened envelope in an upright position standing on one of the opened first, second and third edges; and automatically separating first and second sides of the envelope so as to cause a fourth edge of the envelope which is unopened, to push any contents of the envelope away from the envelope to remove the contents.

* * * * *